US012077934B2

(12) United States Patent
Wahlgren et al.

(10) Patent No.: US 12,077,934 B2
(45) Date of Patent: Sep. 3, 2024

(54) DREDGE SYSTEM

(71) Applicant: Eddy Pump Corporation, El Cajon, CA (US)

(72) Inventors: Daniel Wahlgren, Escondido, CA (US); Benjamin Charles Weinrib, Rancho Santa Fe, CA (US)

(73) Assignee: EDDY PUMP CORPORATION, El Cajon, CA (US)

( * ) Notice: Subject to any disclaimer, the term of this patent is extended or adjusted under 35 U.S.C. 154(b) by 558 days.

(21) Appl. No.: 17/308,162

(22) Filed: May 5, 2021

(65) Prior Publication Data

US 2022/0356671 A1 Nov. 10, 2022

(51) Int. Cl.

| | |
|---|---|
| ***E02F 3/88*** | (2006.01) |
| ***E02F 3/92*** | (2006.01) |
| ***E02F 7/06*** | (2006.01) |

(52) U.S. Cl.

CPC ..... *E02F 3/8816* (2013.01); *E02F 3/9262* (2013.01); *E02F 7/06* (2013.01)

(58) Field of Classification Search

CPC ..... E02F 5/006; E02F 5/28; E02F 3/92; E02F 3/88; E02F 3/8841; E02F 7/065

See application file for complete search history.

(56) References Cited

U.S. PATENT DOCUMENTS 4,914,841 A * 4/1990 Weinrib ..... E02F 3/925 415/58.4

5,203,099 A * 4/1993 Naranjo et al. ..... E02F 5/006 37/313

FOREIGN PATENT DOCUMENTS

WO WO-9907949 A1 * 2/1999 ..... E02F 3/8858

* cited by examiner

*Primary Examiner* — Tara Mayo

(74) *Attorney, Agent, or Firm* — GLOBAL IP COUNSELORS, LLP

(57) ABSTRACT

A dredge system for attachment to a vehicle, the dredge system includes a hopper, a mixer and a pump. The hopper has an internal area and is configured to feed material into the internal area of the hopper. The mixer is coupled to the hopper and configured to shear the material in the internal area of the hopper. The pump is coupled to the hopper and is configured to pump the sheared material through a discharge outlet.

18 Claims, 9 Drawing Sheets

DREDGE SYSTEM

BACKGROUND

Field of the Invention

The present disclosure relates to a dredge system. In particular the present disclosure relates to a dredge system that includes a hopper that is connectable to a movable vehicle.

Background of the Invention

Conventional dredging generally requires four separate steps. For example, conventional dredging usually requires loosening material, extracting the material, transportation and disposal. One conventional dredging system is a trailing suction hopper dredger (TSHD) that trails a suction pipe when working. The pipe, which is fitted with a dredge drag head, loads the dredge spoil into one or more hoppers in the vessel. When the hoppers are full, the TSHD moves to a disposal area and either dumps the material through doors in the hull or pumps the material out of the hoppers.

SUMMARY

It has been determined that an improved dredge system is desired. In view of the state of the known technology, one aspect of the present disclosure is to provide a dredge system for attachment to a vehicle, the dredge system includes a hopper, a mixer and a pump. The hopper has an internal area and is configured to feed material into the internal area of the hopper. The mixer is coupled to the hopper and configured to shear the material in the internal area of the hopper. The pump is coupled to the hopper and is configured to pump the sheared material through a discharge outlet.

Another aspect of the present disclosure is to provide a dredge vehicle comprising a vehicle body, a hopper, a mixer and a pump. The hopper is attached to the vehicle body, the hopper including an internal area and configured to feed material into the internal area of the hopper. The mixer is coupled to the hopper and is configured to shear the material in the internal area of the hopper. The pump id coupled to the hopper and is configured to pump the sheared material through a discharge outlet.

Another aspect of the present disclosure is to provide a method comprising moving a vehicle within a dredging area, feeding material in the dredging area into an internal of a hopper connected to the vehicle, shearing the material in the internal area of the hopper with a mixer coupled to the hopper, and pumping the sheared material through a discharge outlet of a pump coupled to the hopper.

The present invention improves the dredging process by providing a movable vehicle that loosens material, extracts material and transports the material to be disposed in one process. Thus, the present invention can decrease the time and expense in dredging.

Moreover, the present invention is able to remove or dredge dry material. Removal of the dry material can be performed in real time using water jets and mixers that form a slurry to be pumped by the pump.

BRIEF DESCRIPTION OF THE DRAWINGS

The invention will be explained in more detail hereinafter with reference to the drawings.

DETAILED DESCRIPTION OF THE EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
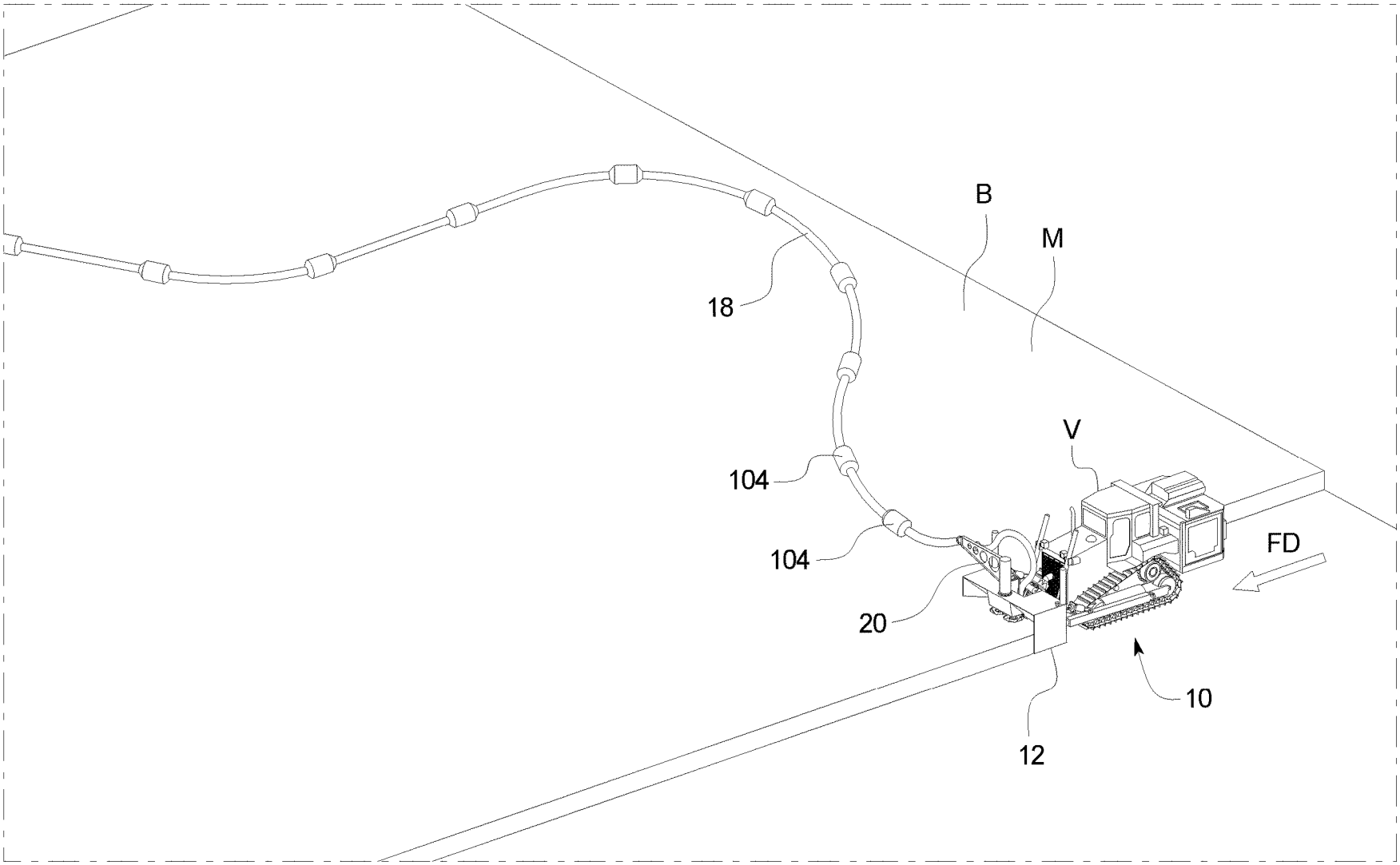
FIG. 1 is a top perspective view of a dredge system according to an embodiment of the present invention disposed on the front of a vehicle.
Figure 2:
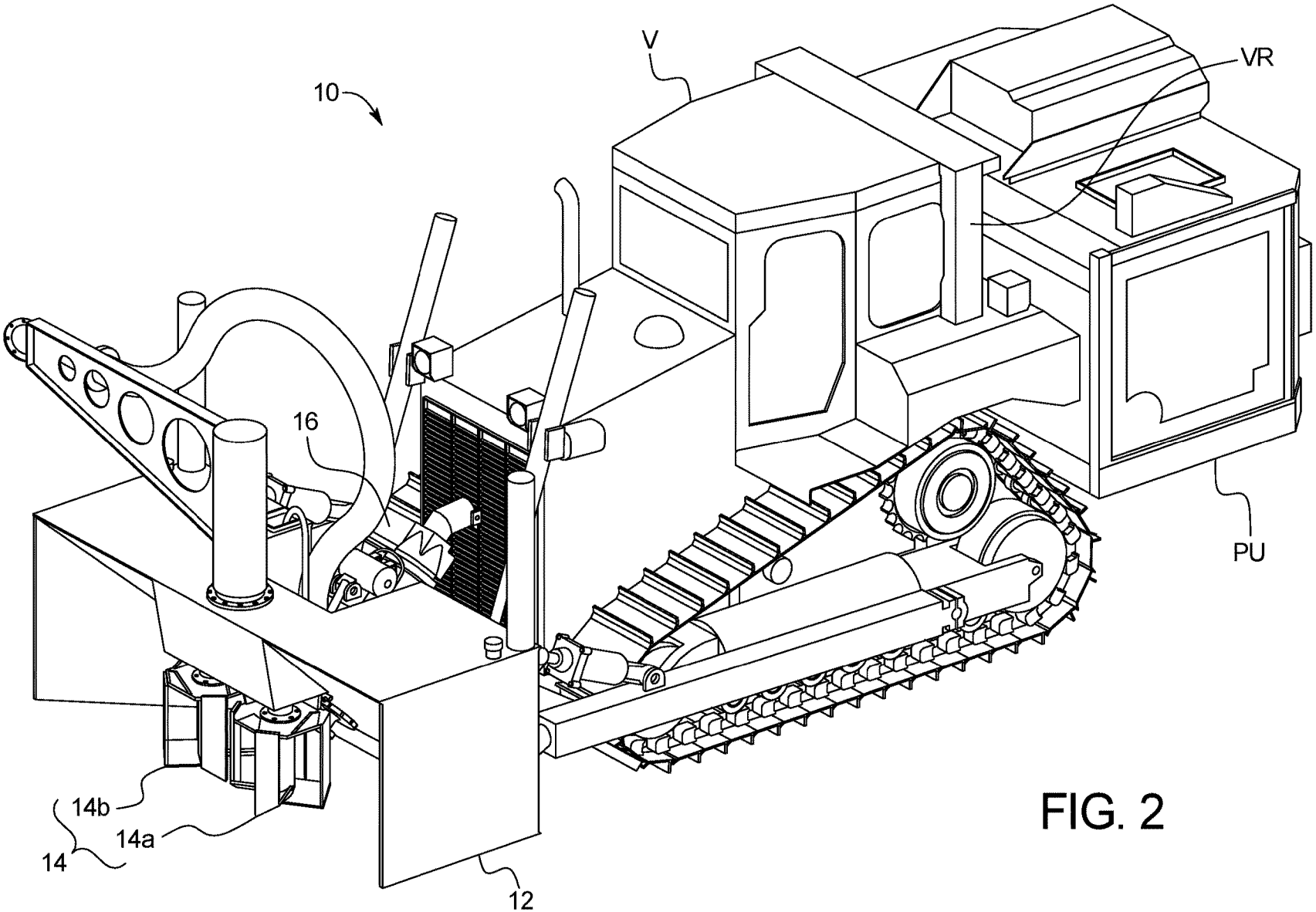
FIG. 2 is enlarged view of the dredge system of FIG. 1.

Referring initially to FIGS. 1 and 2, a dredge system 10 is illustrated in accordance with a first embodiment. The dredge system 10 is coupled to a vehicle V and includes aa mixer 14 and a pump 16. As illustrated the dredge system 10 is coupled to a construction vehicle V such as a bull dozer (e.g., a Caterpillar D6 LGP), but as can be understood the dredge system 10 can be attached to any suitable vehicle V, such as any construction vehicle V, any road vehicle V (such as a pickup truck) or any other suitable automobile.

The dredge system 10 is preferably detachably attached to the front of a construction vehicle V can be moved though material bed B to remove dry material or slurry, or any other suitable material. As illustrated in FIG. 1 the hopper 12 is capable of directing material to the pump 16 which in turn pump the material M through a pipe 18, for example, an high-density polyethylene (HDPE) pipe. The pipe 18 can transport the material M to any suitable location such as, a vehicle V, a stationary tank, and/or reservoir for ultimate removal and disposal.

Figure 3:
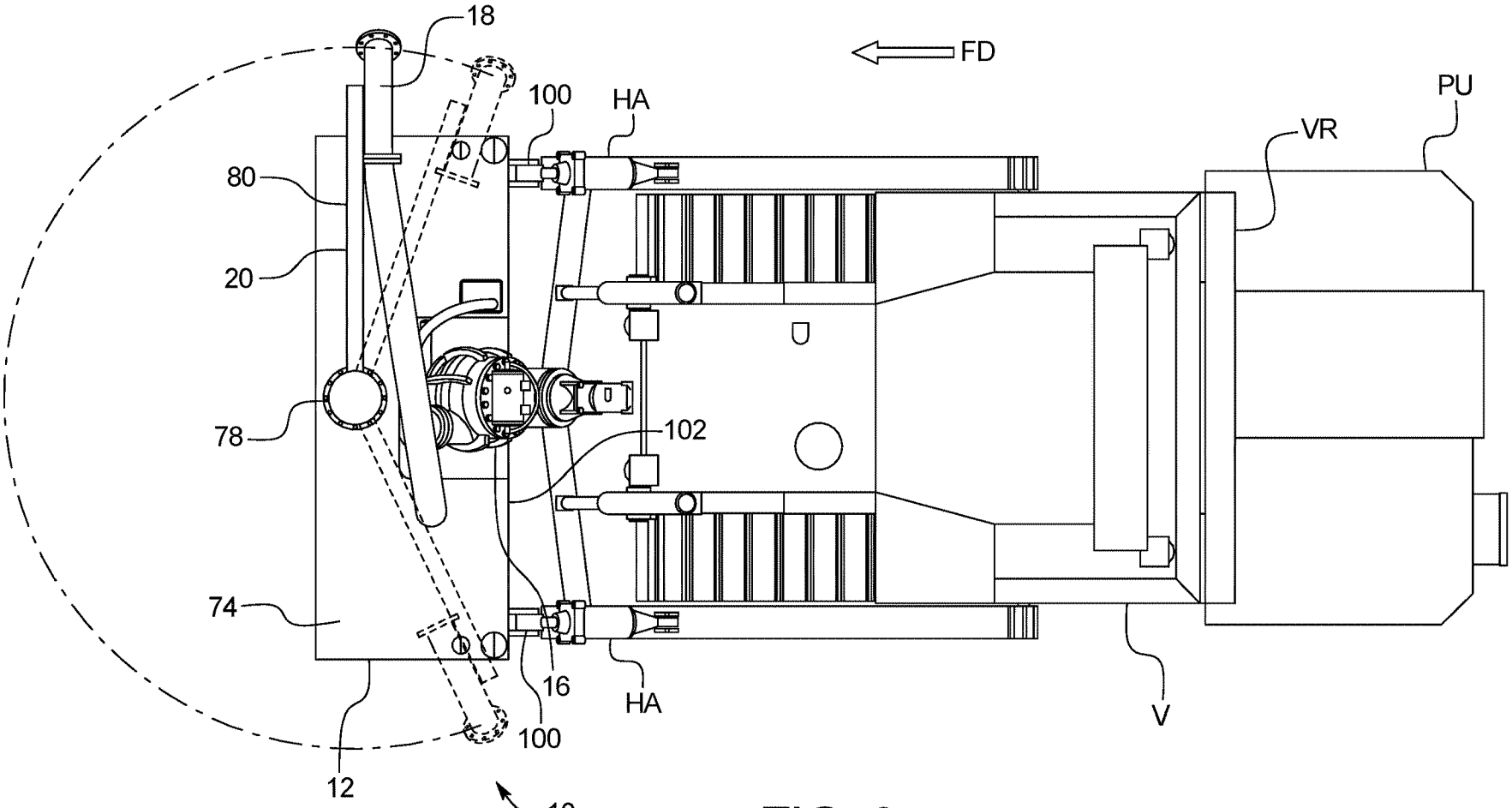
FIG. 3 is a top view of the dredge system of FIG. 1 illustrating the movability of the boom.

As illustrated in FIG. 3, the dredge system 10 can include an articulating boom 20, which enables the pipe 18 to always be disposed on the dredging side of the vehicle V, as shown in FIG. 1. That is, the boom 20 enables the pipe 18 to swing through an angle greater than or equal to 180 degrees (preferably 200 degrees) to enable the vehicle V to move back and forth through the material bed B and have the pipe 18 disposed on the dredge side, as shown in FIG. 1.

Figure 4:
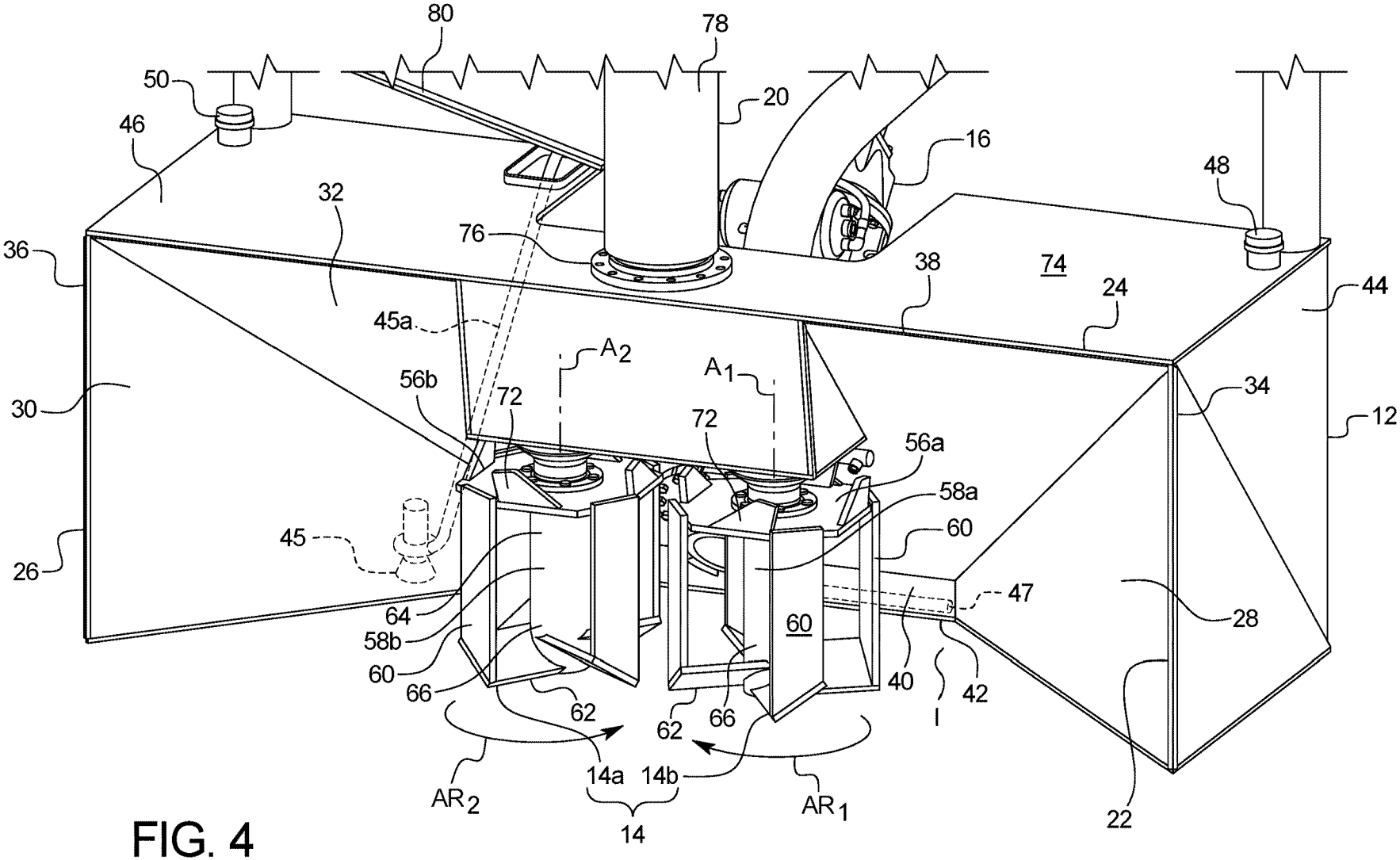
FIG. 4 is a front perspective view of the hopper for the dredge system shown in FIG. 1.

As shown in FIG. 4, the hopper 12 is preferably a metal generally rectangular structure. The hopper 12 can be formed from a metal, such as steel or any other suitable material. The hopper 12 includes internal area I and is configured to feed the material M into the internal area I of the hopper 12. The internal area I includes an opening 22 that is at the front 24 of the hopper 12. In other words, the front 24 of the hopper 12 is completely open to the outer perimeter 26 of the hopper 12 and exposes the internal area I, so as to enable the material M to be guided into the internal area I as the hopper 12 moved in the forward direction FD.

The internal area of the hopper 12 in defined by a left (or first) angled surface 28, a right (or second) angled surface 30 and a rear angled surface 32. The left and right angled surfaces 28, 30 start at the left and right outer perimeter side edges 34 and 36, respectively, of the internal area I and angle inwardly toward the rear portion of the internal area I. The left and right angled surfaces 28, 30 are generally triangular or trapezoidal in shape. The rear angled surface 32 starts at the upper edge 38 of internal area I and angles toward the rear of the internal area I. The rear angled surface 32 is generally triangular or trapezoidal in shape. The rear angled surface 32 is disposed between the left and right angled surfaces 28, 30 such that the internal area I of the hopper 12 forms a funnel like shape to direct the material M to an inlet 40 of the pump 16 at the bottom 42 of the internal area I. It is noted that this description of the internal area I is preferred, but the internal area I can be defined in any suitable manner.

The hopper 12 can, in one embodiment, include at least one internal water tank 44. In one embodiment, the hopper 12 includes first and second internal water tanks 44 and 46 with inlets 48, 50 to fill the tanks. Each tank 44 and 46 can be a 250 gallon water tank disposed on the left and right sides of the hopper 12. The water tanks 44 and 46 can be configured to supply water to facilitate priming of the pump 16, if desired. Thus, as can be understood, water can be inserted in the inlet 40 or suction portion of the pump 16 in any manner desired.

In one embodiment, the tank 44 includes a pump. For example, tank 44 includes a pump 45. In this embodiment the tanks 44 and 46 can be in fluid communication with each other such that the fluid in tank 46 can be pumped using the pump 45. In one embodiment, the tanks are in fluid communication via a tank cross over pipe 47 disposed along the bottom of the hopper 12. However, it is noted that the tanks can be separate from each other and the tank 46 can have a separate pump that is substantially identical to the pump 45.

The pump 45 is disposed in the bottom of the tank 44 to enable access to the fluid disposed therein. Extending from the top portion of the pump is a hose 45*a* that exits the tank through an opening 74*a* in the top surface 74 of the tank 44 and connects to a jetting manifold. The jetting manifold can be a longitudinal cylindrical structure that is generally disposed between the tanks 44 and 46. The jetting manifold 49 is connected to the rear angled surface 32 of the hopper 12 such that a plurality of jets 49*a* extend through the rear angled surface 32 of the hopper 12 and are arranged to spray the fluid F in the direction of the mixer 14. The jetting manifold 49 can spray the fluid F through the plurality of jets 49*a* intermittently to prime the material M when the material M is dry. It should be understood that the jetting manifold 49 can spray the fluid F through the plurality of jets 49*a* continuously or in any manner desired.

The pump 45 can operate using the power supply or using any other suitable power source.

Figure 5:
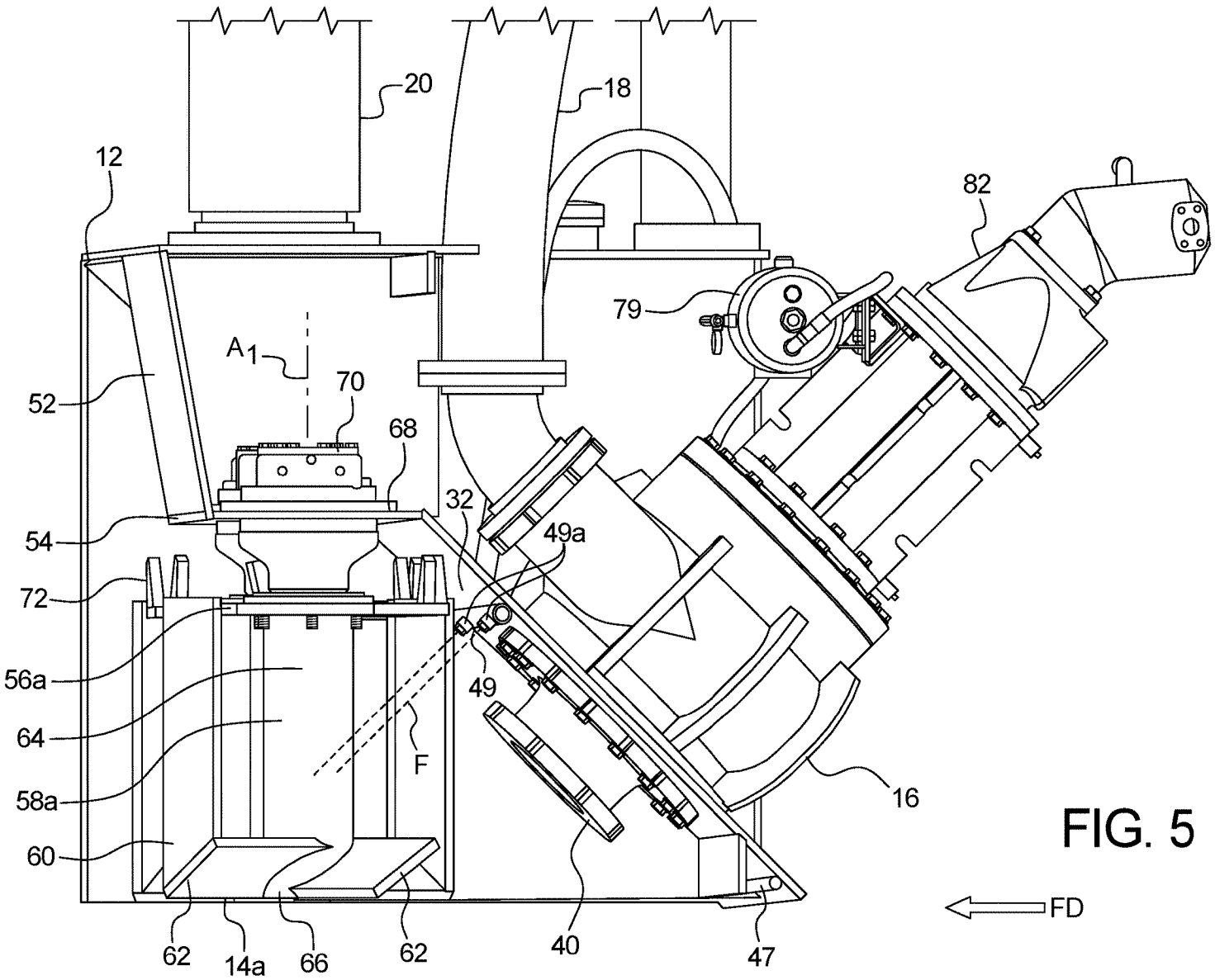
FIG. 5 is a side view in section of the hopper for the dredge system shown in FIG. 1.

As shown in FIGS. 4 and 5, the internal area of the hopper 12 can house at least one mixer 14. In one embodiment, first and second mixers 14*a* and 14*b* are disposed within at least a portion of the internal area I. The mixers 14*a* and 14*b* are supported by a housing structure 52 that is formed within the internal area I. The housing structure 52 includes a metal flange 54 or surface that extends generally parallel to the direction of travel (i.e., the forward direction) and is configured to support the mixers 14*a* and 14*b* such that the mixers 14*a* and 14*b* can be disposed with an axis of rotation $A_1$ and $A_2$ that is generally perpendicular (or transverse) to the direction of travel.

The first and second mixers 14*a* and 14*b* are preferably counter rotating high speed mixers 14*a* and 14*b* that are configured to shear thin the material M and feed the material M into the inlet 40 of the pump 16. As can be understood, in one embodiment, the first mixer 14*a* rotates clockwise (arrow $AR_1$), and the right mixer 14 rotates counterclockwise (arrow $AR_2$) such that first and second mixers 14*a* and 14*b* rotate in opposite directions. Each mixer 14*a* and 24*b* has a diameter that is the same, and in one embodiment, the mixers 14*a* and 14*b* can arranged such that the area of rotation between the mixers 14*a* and 14*b* overlaps. Thus, the mixers 14*a* and 14*b* are configured to rotate such that they do not contact each other. This arrangement further enhances the shearing of the material.

In one embodiment, each of the mixers 14*a* and 14*b* includes an upper plate 56*a* and 56*b*, a shaft 58*a* and 58*b*, a plurality of metal blades 60, and a plurality of angled surfaces 62. The shafts 58*a* and 58*b* have a first end 64 and a second end 66. The first end 64 is attached to a bearing 68 and a high torque mixer head drive motor 70 to rotate and drive the mixer 14.

The plate 56*a* and 56*b* for each mixer 14*a* and 14*b* is connected to the shaft 58*a* and 58*b* and extends generally transverse to the shaft 58*a* and 58*b* and transverse to the rotational axis $A_1$ and $A_2$. The plate 56*a* and 56*b* can also include upwardly extending blades 72 that can help shear the material M. In one embodiment, the mixers 14*a* and 14*b* include four upwardly extending blades 72 that extend in the same generally direction as the axis of rotation $A_1$ and $A_2$.

The plurality of blades (e.g., four blades) 60 extend in substantially the same direction as the axis of rotation $A_1$ and $A_2$ of the mixers 14*a* and 14*b* downwardly from the plate 56*a* and 56*b*. The blades 60 can be angled in the longitudinal direction relative to the rotational direction of travel $AR_1$ and $AR_2$. In other words, the blades 60 can be angled outwardly relative to the tangent of the arc formed by the rotational direction of travel $AR_1$ and $AR_2$.

The blades 60 can further include the upwardly angled surface 62 that facilitates shearing of the material M. The upwardly angled surfaces 62 can be attached to the bottom of the blades 60 and the bottom of the shaft 66 and extend therebetween.

As shown in FIG. 4, the discharge boom 20 is connected to the upper surface 74 of the hopper 12 and rotates on a pivot 76. A shaft 78 extends upwardly from the upper surface 74 and has an axis of rotation that enables the boom 20 to travel in either direction in an arc of at least 180 degrees or any suitable arc. A boom arm 80 extends radially outwardly from the shaft 78 and is configured to have the pipe 18 coupled thereto, thereby enabling the pipe 18 to swing along with the boom arm 20.

The pump 16 is preferably an eddy pump 16, and includes a run dry pump seal system 79 and is driven by a drive motor 82.

That is, the pump 16 can be an eddy pump 16, for example, as described in U.S. patent application Ser. No. 16/176,495, filed Oct. 31, 2018 and entitled Eddy Pump 16, the entire contents of which are herein incorporated by reference.

Figure 6:
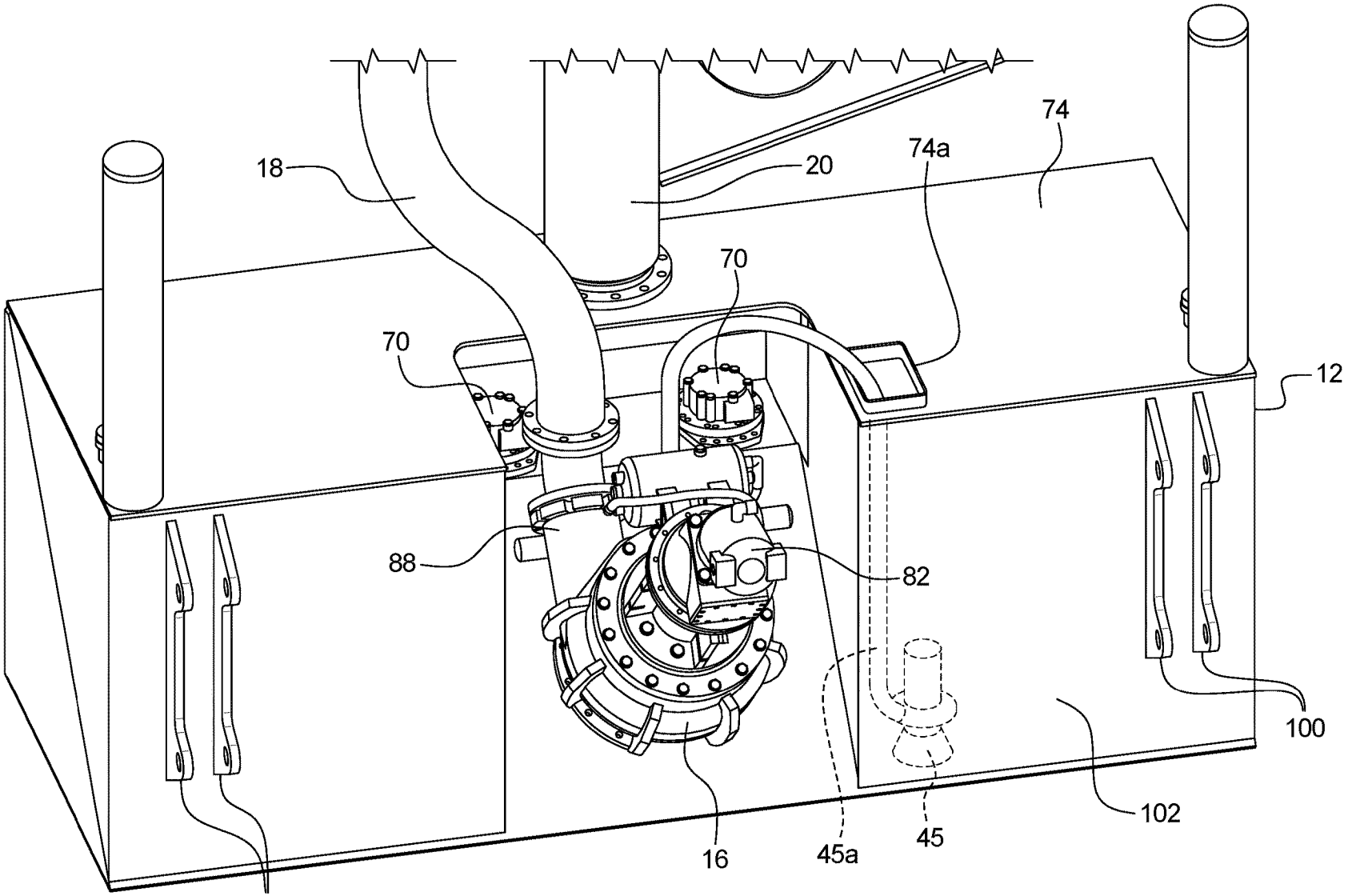
FIG. 6 is a rear perspective view of the hopper for the dredge system shown in FIG. 1.
Figure 7:
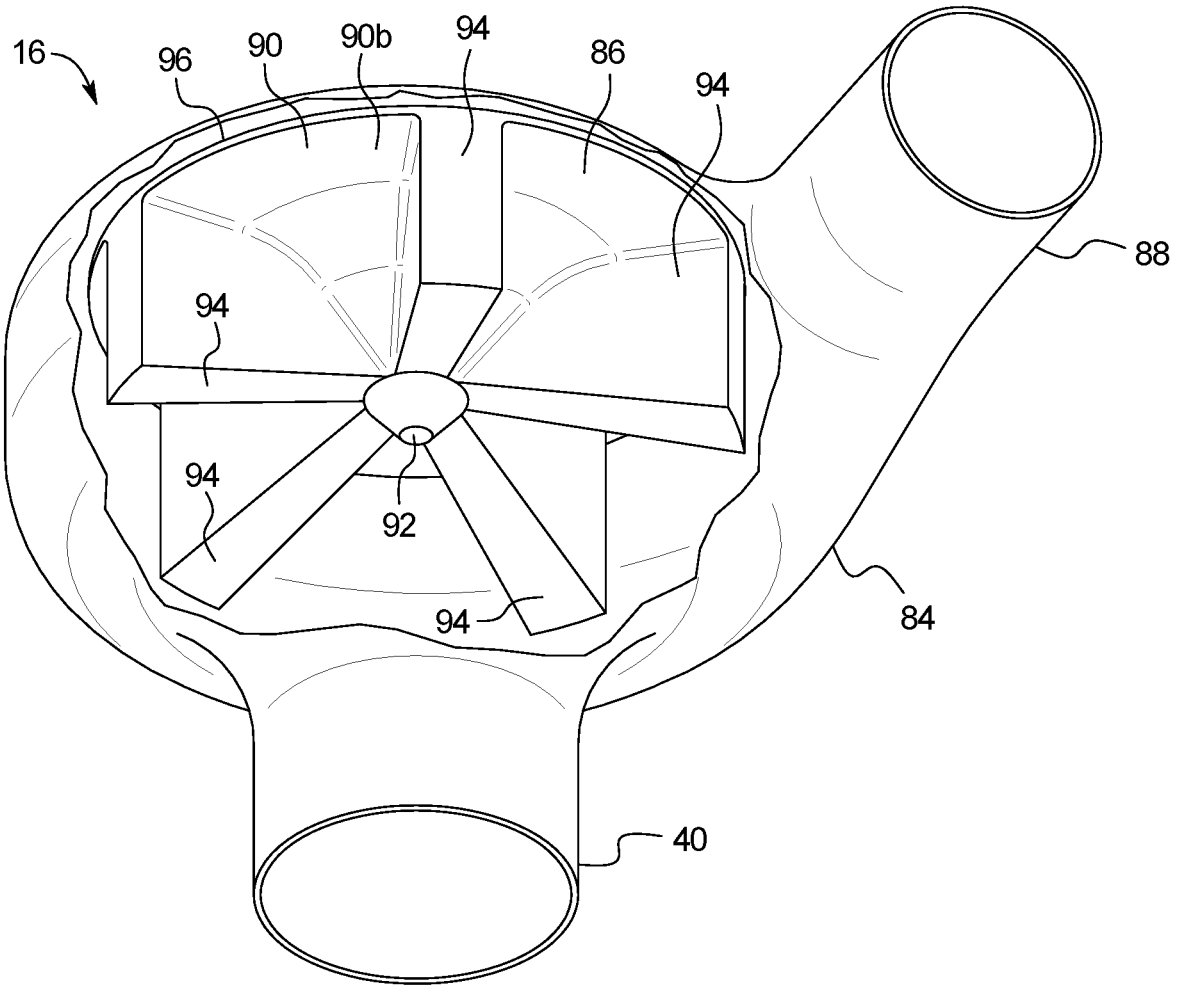
FIG. 7 is a bottom perspective view in section illustrating one embodiment of an eddy pump.
Figure 8:
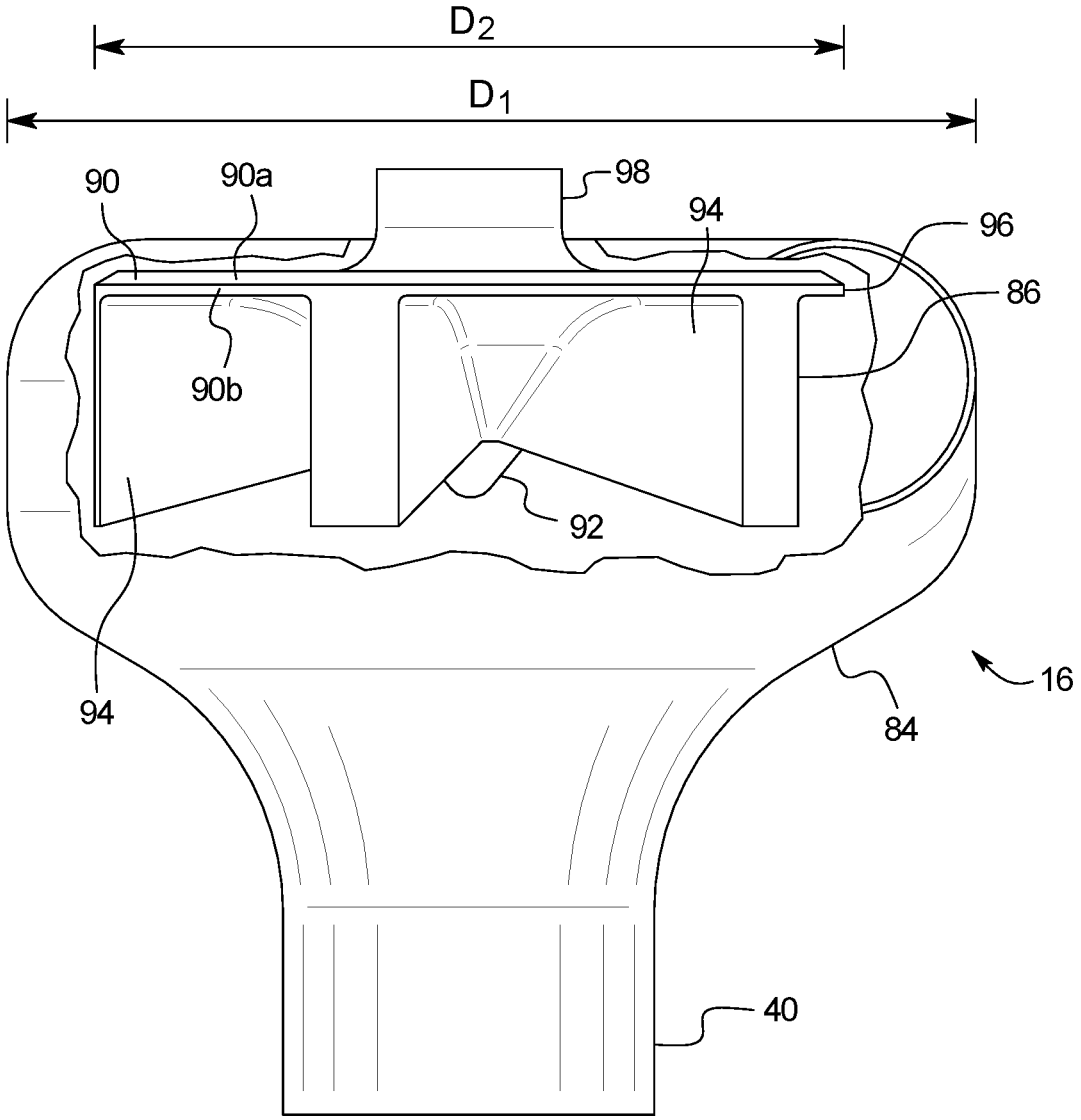
FIG. 8 is a side view in section illustrating the embodiment of an eddy pump of FIG. 7.
Figure 9:
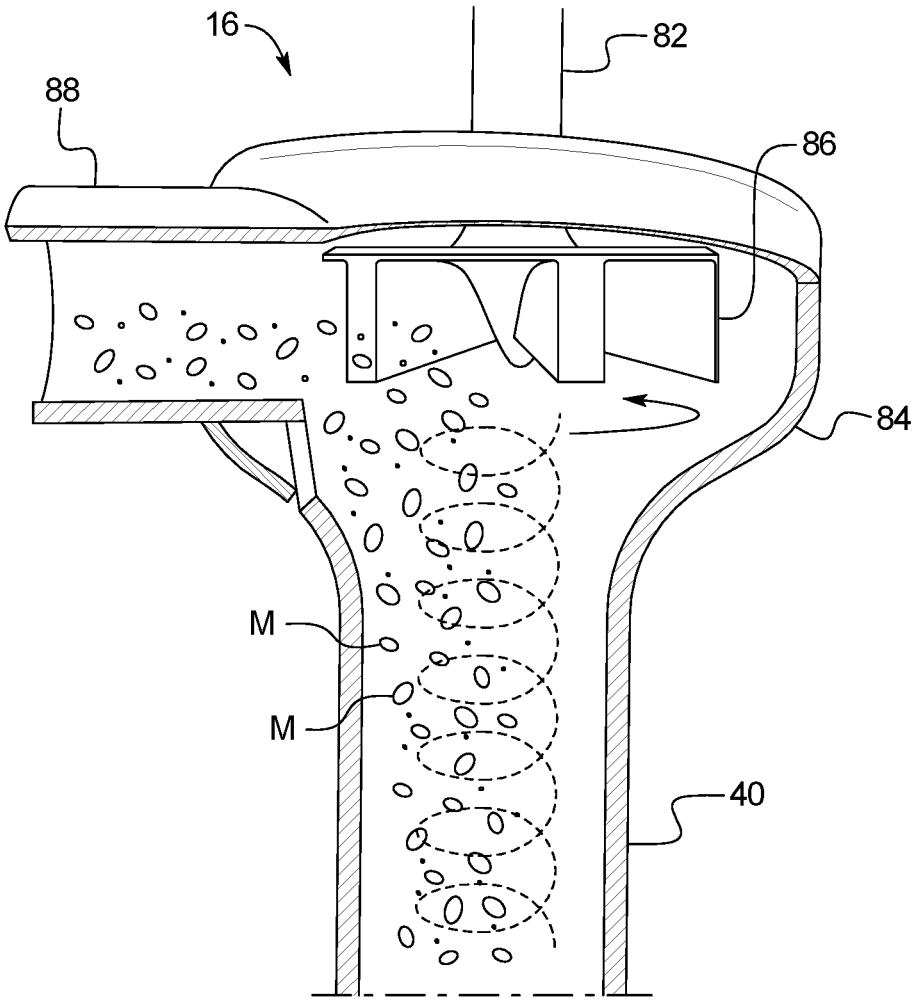
FIG. 9 is another side view in section illustrating the embodiment of an eddy pump of FIG. 7 in operation.

As discussed, the pump 16 can be disposed on the hopper 12 and is in communication with the pipe 18. As shown in FIGS. 7-9, the eddy pump 16 includes a drive motor 82, a volute or housing 84 and a rotor 86. The rotor 86 is disposed within the housing 84 such that fluid, liquids, materials, and slurries can enter the housing 84 and be pumped by the rotor 86. The rotor 86 is connected to the drive motor 82 (FIGS. 6 and 8) that is configured to drive or rotate the rotor 86 to pump 16 fluid, liquids, materials, and slurries from the inlet to the discharge. The motor 82 can be any suitable motor know in the art that would be capable of driving the rotor 86 at suitable rotational velocities.

As shown in FIGS. 7-9, the housing 84 is curved and includes an inlet 40 and a discharge outlet 88. The inner surface of the housing 84 is generally cylindrical and has a diameter $D_1$ that is larger than the diameter $D_2$ of the rotor 86. The inlet 40 is disposed along a radial axis of the rotor 86 on the bottom of the housing 84, which enables the fluid or materials to be sucked or drawn into the housing 84 based on the rotation of the rotor 86. The outlet 88 is disposed 90 degrees offset from the inlet 40 (i.e., in a direction tangential to the rotor 86), which enables the fluid or materials to be pump 16*ed* out of the housing 84 and is connected to the pipe 18.

The rotor 86 includes a back plate 90, a conical center portion (hub) 92 and a plurality of blades 94. The rotor 86 can be cast, molded, forged, machined, or formed in any suitable manner. Thus, the back plate 90, the conical center portion 92 and the plurality of blades 94 can be formed as a unitary one-piece member. The rotor 86 can be an alloy, steel, stainless steel, aluminum, zinc, bronze, rubber, plastic or any other suitable material or combination of materials. Moreover, it is noted that the rotor 86 can be any suitable mater or design. Thus, while the rotor 86 is preferable a unitary one-piece member, the rotor 86 can be formed from in multiple steps or by multiple pieces that are assembled in any suitable manner.

In one embodiment, the back plate 90 is a generally circular plate having a first side (defining a first planar surface) 90*a*, a second side (defining a second planar surface) 90*b* and an outer circumferential edge 96. The first or upper side 90*a* faces the interior of the housing 84 and has a protrusion or shaft 63 extending therefrom. The protrusion 98 is connected to or connectable to a drive shaft from the drive motor 82. The second side 90*b* has the plurality of blades 94 disposed thereon. As shown in FIG. 78, the back plate 90 extends form the center of the rotor 86 about the same length as the rotor 86, and thus covers the entire rotor blade length. In other words, the plurality of blades 94 defines a radial diameter, and the back plate 90 has a diameter that is the same as or about the same as the radial diameter of the back plate 90. However, it is noted that the radial diameter of the back plate 90 can be between 0.3 and 1.0 the radial diameter defined by the plurality of blades 94, depending on the particle size, or any other parameter. This configuration (i.e., a "full size" back plate) prevents fluid from escaping the rotor 86 and facilitates pushing the fluid circumferentially towards the outlet 88 of the rotor 86 and discharge. Moreover, the back plate 90 helps reduce recirculation by maintaining fluid distribution inside the volume of the rotor 86, and prevents leakage and energy losses between the rotor 86 and upper side of the housing 84. The back plate 90 also helps reduce static pressure loss, which contributes to higher pressure differential and head developed by the rotor 86.

As shown in FIGS. 7 and 8, the conical center portion 92 is a cone disposed in the center of the rotor 86 and facilitates fixing the rotor 86 to the motor shaft 62. The conical center portion 92 is disposed on the second side 90*b* of the back plate 90 and is opposite to the protrusion 62. The conical center portion 92 has a vertex and a base. The base is adjacent the back plate 90 and tapers toward the conical vertex. The base radially extends about 50 percent of the base plate. The conical vertex of the hub forms an angle of about 40 degrees. However, the size of the base of the conical center portion 92 and the angle formed by the conical vertex can be any suitable or desired size or angle.

The conical center portion 92 helps hydraulically by causing suction which enables the fluid to flow inside the housing 84 smoothly from the inlet 40 and facilitates laminar movement towards the outlet or end of the rotor 86 and subsequently to the discharge. This induction of laminar flow aids in reduction of eddy currents and recirculation inside the housing 84, increasing pump 16 efficiency. The size of the conical center portion 92 (length, diameter, and angle) can depend on the particle size, allowing better clearances of the particles, as long as laminar flow can be maintained towards the discharge. The conical center portion 92 also helps create better eddy current from the suction to the inlet 40 of the rotor 86 while preventing turbulence at higher flow rates than the best efficiency point allowing the pump 16 a flow rate 140% of the design best efficiency point. The size of the cone can be reduced or increased to control power consumption.

As shown in FIGS. 7 and 8, the plurality of blades 94 extends from the conical center portion 92 and is disposed on the second side 90*b* of the back plate 90. In this embodiment, the plurality of blades 94 includes five (5) blades, but the plurality of blades 94 can be any suitable number of blades that form a suitable eddy current. Each of the blades includes a first side, a second side, an end, and a bottom surface. Each of the blades 94 extends radially outwardly from the conical center portion 92 and along a longitudinal direction from the back plate 90. Moreover, since the conical center portion 92 is a cone having a sloping surface, each of the blades 94 follows the sloping contour of the conical center portion 92, see FIG. 7 for example.

The first longitudinal side and a second longitudinal side of the blades 94 are opposite each other. The first and second longitudinal sides extend in the longitudinal direction, generally parallel to the longitudinal axis of the rotor 86 and taper away from each other in the radial direction. That is, as shown in FIGS. 7 and 8, the first and second longitudinal sides are disposed about 1.5 inches apart adjacent the conical center portion 92 and 2 inches apart adjacent the circumferential edge of the back plate 90. Accordingly, as can be understood, the first and second longitudinal sides separate about 0.5 inches in the radial direction. It is noted that the first and second longitudinal sides can separate in any manner desired or can be parallel, if desired. Moreover, if the size of the rotor 86 is changed, the change in separation of the first and second longitudinal sides can be changed accordingly. That is, in the embodiment, the change in the separation of the first and second longitudinal sides is about 33 percent. In other words, the separation between the first and second longitudinal sides at the peripheral edge of the back plate 90 is about 33 percent larger than the separation of the first and second longitudinal sides adjacent the conical center portion 92.

In one embodiment, each of the blades 94 tapers upwardly from the peripheral edge of the back plate 90 to the conical center portion 92. The bottom surface of each blade 58 extends from a first end to a second end. The first end is adjacent the conical center portion 92 and the second end is adjacent to the outer surface. The second end preferably is higher than the first end when measured from the second side 90*b* of the back plate 90. For example, in one embodiment, the first end is approximately 3.17 inches from the back plate and the second end is 5 inches from the back plate. However, it is noted that the first and second ends can be any suitable distance from the back plate. Moreover, if the size of the rotor 86 is changed the change in heights of the first and second longitudinal ends can change accordingly. That is, in this embodiment the difference in the heights of the first and second ends is about 58 percent. In other words, the height of the second end is 58 percent higher than the height of the first end.

The outer surface of the blades 94 can be seen in at least FIGS. 7 and 8. The outer surface is preferably a rectangular and is essentially parallel with a rotational axis of the rotor 86. As shown specifically in FIG. 8, the outer surface forms a right angle (90 degrees) with the back plate 90. Moreover, the outer surface extends generally parallel with the inner surface of the housing 84 and is spaced a prescribed distance therefrom. Such a configuration enables particles to be disposed between the outer surface and the inner surface of the housing 84.

Additionally, the bottom surface of the blades 94 forms an angle of 75 degrees with the outer surface and an angle of about 15 degrees with a line parallel to the second side 90*b* of the back plate 90. This tapering results in the conical center portion 92 having a height from the second side 90*b* of the back plate 90 that is greater than the height of the first end and less than the height of the second end. Thus, in one embodiment, the conical center portion 92 has a height of 4.27 inches. Thus, as can be understood, the height of the conical center portion 92 is about 83 percent of the height of the second end and about 38 percent greater than the height of the first end. However, the height of the conical center portion 92 can be any suitable height.

Thus, as can be understood, the height of each of the blades 94 increases from the center of the rotor 86 towards the outside diameter or the peripheral edge of the back plate 90, on the suction side of the rotor 86. This structure enhances the eddy currents for improved suction of fluid and creates clearance for larger particle sizes. The rotor blade height at outside diameter is kept close to the height of the discharge or the diameter of the discharge so as to be capable of pushing fluids directly into the discharge. This configuration reduces leakage, recirculation, and pressure losses. The tapering blade height also helps reduce the torque, and thus reduce the power consumed versus uniform blade height from center to outer diameter. The outer blade height can also be varied in proportion to the outlet diameter of the housing 84, keeping the dimensions similar if desired.

As shown in FIG. 8, each of the blades 94 is spaced a predetermined distance from the housing 84. Generally, the clearance between the blades and the housing 84 is kept at an additional 10-15% of the maximum particle size that is estimated to be in the material. This enables the rotor 86 to pass particles of significant size while reducing the wear of the blades in the rotor 86.

A rotor having five blades is the preferable number of blades to reduce eddy current formation and recirculation between the rotor blades. It has been found that too few blades can cause turbulence and may not enable higher flow rates to create the required pressure differential. Too many blades may reduce clearances prohibiting larger size particles from passing through the pump 16 and may reduce fluid volume allowable for ideal flow rate. However, the rotor 86 can have any suitable number of blades that will enable some flow with a suitable amount and size of particles to pass through the housing 84.

Embodiments described herein reduce Net Positive Suction Head (NPSH) because the embodiments can handle lower suction pressures and subsequent cavitation significantly better due to smoother streamlines relative the conventional systems. This improves the suction performance of the pump 16 and reduces the chances of cavitation and pump 16 damage.

As can be understood, embodiments of the pump 16 described herein do not rely on the centrifugal principle of conventional pump 16*s*. Instead of a low tolerance impeller of a conventional pump 16, the pump 16*s* described herein use a specific geometric, recessed rotor 86 to create a vortex of fluid or slurry like that of a tornado. That is, the Eddy Pump 16 operates on the tornado principle. The tornado formed by the Eddy Pump 16 and the rotor 86 generates a very strong, synchronized central column of flow from the pump 16 rotor to the pump 16 inlet 40 and creates a low-pressure reverse eddy flow from the pump 16 inlet 40 to the pump 16 discharge. This action also results in an area of negative pressure near the pump 16 seal. The negative pressure allows the pump 16 to achieve zero leakage.

Further open rotor design described herein has high tolerances that enable any substance that enters the intake to be passed through the discharge without issues. This translates to a significant amount of solids and debris that passes through without clogging the pump 16. In one embodiment, the pump 16 is capable of pumping up to 70% solids by weight and/or slurries with high viscosity and high specific gravity.

The configuration of the rotor 86 so as to be recessed also creates eddy current that keeps abrasive material away from critical pump 16 components. This structure improves pump life and reduces pump wear.

The tolerance between the rotor 86 and the housing 84 easily allows the passage of a large objects significantly greater than that of a centrifugal pump 16. For example, in a 2-inch to 10-inch Eddy Pump 16 the tolerance ranges from 1-9 inches. Thus, this type of pump 16 is preferably for pump 16*ing* the solid materials from the drilling operation.

The embodiments described herein can have additional advantages, such as low maintenance, minimal downtime, low ownership costs and no need for steel high-pressure pipe line.

Since the Eddy Pump 16 is based on the principle of Tornado Motion of liquid as a synchronized swirling column along the center of intake pipe 18 that induces agitated mixing of solid particles with liquid, suction strong enough for solid particles to travel upwards into the housing or volute 44 and generating pressure differential for desired discharge is created. This eddy current is formed by the pressure differential caused by the rotor 86 and strengthened by turbulent flow patterns in the housing or volute 44 and suction tube. Eddy currents are strengthened by the presence of solid particles which increase the inertial forces in the fluid. The formation of the eddy depends on the suspended solid particles that causes suction. Unlike conventional vortex pump 16*s*, the rotor 86 directly drives the fluid through the pump 16 with no slip. The Eddy Pump 16 uses the movement of particles and the wake induced from these solid particles to generate Eddy Current and induce suction. Hence, efficiency is 7-10% better than conventional vortex pump 16*s*, with respect to horsepower. The eddy current generated by the Eddy Pump 16 ensures steady movement of the mixture that leads to excellent non-clumping capabilities and the power to pump 16 a very high concentration of solids, up to 70% by weight, and highly viscous fluids.

While the pump 16 is preferably an Eddy Pump 16 as described herein, the pump 16 can be any suitable pump 16 and is not necessarily limited to an Eddy Pump 16.

As illustrated in FIG. 2, the vehicle V can include a power unit PU, such as a 350 HO hydraulic power unit to supply power to the hopper 12 (e.g., the mixers 14*a* and 14*b* and the pump 16). The power unit PU can be attached to the rear portion VR on the vehicle V, or any other suitable portion to enable powering of the element on the hopper 12. In another embodiment, the vehicle V can include another power source that can run the elements of the hopper 12 and the power source coupled to the vehicle V may not be necessary.

In operation, the hopper 12 is attached to the vehicle V using brackets 100 disposed on the rear surface 102 of the hopper 12. The brackets can be attached to hydraulic actuators HA that enable the hopper to be pivoted in an upward and downward direction, such the hopper can be positioned away from the ground when not in use. The pump outlet 88 is attached to the pipe 18 and the pipe 18 is connected to the boom arm 80. The boom arm 80 is pivoted to the dredge side of the vehicle V, such that the pipe 18 is disposed on the dredge side of the vehicle V (see FIG. 1), and the vehicle V is moved along or through the material bed B. The pump 16 and the mixers 14*a* and 14*b* can be started with the drive motor 82 and with a respective mixer head drive motor 70. The power to drive the drive motor 82 and with a respective mixer head drive motor 70 can be supplied from the power unit PU. As discussed herein, the pump 16 can be primed with water from the tanks 44 and 46 in the hopper 12 if desired or necessary.

The material bed B can be a dry material or slurry, or any other suitable material. As the vehicle V moves through the material bed B, material M is fed into the hopper 12. The material M is directed to the mixers 14*a* and 14*b* based on the shape of the internal space I of the hopper 12, and the mixers 14*a* and 14*b* shear and/or mix the material M and feed the material M to the pump 16 inlet 40. The pump 16 then pumps the material M out through the discharge outlet 88 and into the pipe 18, which in turn deposits the material M in a suitable location such as, a vehicle, a stationary tank, and/or reservoir for ultimate removal and disposal. As the vehicle V moves through the material bed B, the pipe 18 is configured to travel along with the vehicle V. In one embodiment, the pipe 18 includes floats 104 configured to be rotatable about an outer surface of the pipe 18 to enable the pipe 18 to move with the vehicle V. The floats 104 further enable the pipe 18 to remain on top of the surface if the material M if liquid or semiliquid or otherwise formed from a material M that would enable the pipe 18 to sink therein.

As the vehicle V approaches or reaches one end of the material bed B, the vehicle V can then turn 180 degrees to move through the bed B in an opposite direction. The boom 20 can then pivot to the other side of the vehicle V, so that the pipe 18 is moved to the other side of the vehicle V. Thus, the pipe 18 is always on the side of the vehicle V facing the direction of the travel of the pipe 18.

The boom arm 20 can rotate via the force caused by the weight of the pipe 18, or the boom 20 arm can be moved automatically using a motor or other suitable device.

The vehicle V is conventional component that is well known in the art. Since vehicle V is well known in the art, this structure will not be discussed or illustrated in detail herein. Rather, it will be apparent to those skilled in the art from this disclosure that the vehicle V can include any type of structure and/or programming that can be used to carry out the present invention.

The embodiments of the present invention described herein improve the dredging process by providing a movable vehicle that loosens material, extracts material and transports the material to be disposed in one process. Thus, the embodiments of the present invention described herein can decrease the time and expense in dredging.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), directional terms refer to those directions of a dredge system. Accordingly, these terms, as utilized to describe the present invention should be interpreted relative to a dredge system.

The term "configured" as used herein to describe a component, section or part of a device or element includes hardware and/or software that is constructed and/or programmed to carry out the desired function.

The terms of degree such as "generally", "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A dredge system for attachment to a vehicle, the dredge system comprising:

a hopper having an internal area and configured to receive material into the internal area of the hopper;

a first mixer coupled to the hopper and configured to shear the material in the internal area of the hopper;

a pump coupled to the hopper and configured to pump the sheared material through a discharge outlet;

a water delivery system configured to prime the material prior to the material entering the hopper, when the material is dry to enable the material to be received by the hopper; and a second mixer, the first and second mixers configured to rotate on parallel axes and the second mixer configured to rotate in a direction opposite a direction of the first mixer.

2. The dredge system of claim 1, wherein the discharge outlet is in communication with a pipe that enables the hopper to move with the vehicle.

3. The dredge system of claim 2, wherein the pipe is connected to a discharge boom, the discharge boom rotatable around a pivot.

4. A dredge system for attachment to a vehicle, the dredge system comprising:

a hopper having an internal area and configured to receive material into the internal area of the hopper;

a mixer coupled to the hopper and configured to shear the material in the internal area of the hopper;

a pump coupled to the hopper and configured to pump the sheared material through a discharge outlet; and a water delivery system configured to prime the material prior to the material entering the hopper, when the material is dry to enable the material to be received by the hopper, the hopper including a tank configured to receive water and the water delivery system configured to deliver the water into the internal area of the hopper.

5. The dredge system of claim 1, wherein the first and second mixers are configured to be rotated by a drive motor.

6. The dredge system of claim 1, wherein the pump is an eddy pump.

7. The dredge system of claim 1, further comprising a power unit configured to be disposed on the vehicle.

8. The dredge system of claim 1, wherein the water delivery system includes a jet attached to the hopper configured to prime the material before entering the pump.

9. A dredge for attachment to a vehicle, the dredge system comprising:

a hopper having an internal area and configured to receive material into the internal area of the hopper;

a mixer coupled to the hopper and configured to shear the material in the internal area of the hopper;

a pump coupled to the hopper and configured to pump the sheared material through a discharge outlet; and a water delivery system configured to prime the material prior to the material entering the hopper, when the material is dry to enable the material to be received by the hopper, the discharge outlet in communication with a pipe that enables the hopper to move with the vehicle, and the pipe including at least one float configured to be rotatable about an outer surface of the pipe to enable the pipe to move with the vehicle.

10. A dredge vehicle comprising:

a vehicle body;

a hopper attached to the vehicle body, the hopper including an internal area and configured to receive material into the internal area of the hopper;

a mixer coupled to the hopper and configured to shear the material in the internal area of the hopper;

a pump coupled to the hopper and configured to pump the sheared material through a discharge outlet; and a water delivery system configured to prime the material prior to the material entering the hopper, when the material is dry to enable the material to be received by the hopper, the hopper includes a tank configured to receive water and the water delivery system configured to deliver the water into the internal area of the hopper.

11. The dredge vehicle of claim 10, wherein the discharge outlet is in communication with a pipe that enables the hopper to move with the vehicle.

12. The dredge vehicle of claim 11, wherein the pipe is connected to a discharge boom, the discharge boom rotatable around a pivot.

13. The dredge vehicle of claim 10, wherein the mixer is configured to be rotated by a drive motor.

14. The dredge vehicle of claim 10, wherein the pump is an eddy pump.

15. The dredge vehicle of claim 10, further comprising a power unit configured to be disposed on the vehicle.

16. A dredge vehicle comprising:

a vehicle body;

a hopper attached to the vehicle body, the hopper including an internal area and configured to receive material into the internal area of the hopper;

a first mixer coupled to the hopper and configured to shear the material in the internal area of the hopper;

a pump coupled to the hopper and configured to pump the sheared material through a discharge outlet;

a water delivery system configured to prime the material prior to the material entering the hopper, when the material is dry to enable the material to be received by the hopper; and a second mixer, the first and second mixers configured to rotate on parallel axes and the second mixer configured to rotate in a direction opposite a direction of the first mixer.

17. A dredge vehicle comprising:

a vehicle body;

a hopper attached to the vehicle body, the hopper including an internal area and configured to receive material into the internal area of the hopper;

a mixer coupled to the hopper and configured to shear the material in the internal area of the hopper;

a pump coupled to the hopper and configured to pump the sheared material through a discharge outlet; and a water delivery system configured to prime the material prior to the material entering the hopper, when the material is dry to enable the material to be received by the hopper, the discharge outlet is in communication with a pipe that enables the hopper to move with the vehicle, and the pipe includes at least one float configured to be rotatable about an outer surface of the pipe to enable the pipe to move with the vehicle.

18. A method comprising:

moving a vehicle within a dredging area;

receiving material in the dredging area into an internal area of a hopper connected to the vehicle;

shearing the material in the internal area of the hopper with a mixer coupled to the hopper and a second mixer coupled to the hopper, the first and second mixers rotating on parallel axes and the second mixer rotating in a direction opposite a direction of the first mixer;

priming the material with a water delivery system prior to the material entering the hopper, when the material is dry to enable the material to be received by the hopper; and pumping the sheared and primed material through a discharge outlet of a pump coupled to the hopper.

* * * * *